United States Patent [19]
Zins et al.
[11] 4,286,012
[45] Aug. 25, 1981

[54] LONG WETTING TIME WOVEN FABRIC

[75] Inventors: Howard M. Zins, Manchester; Edward L. Morris, Jr., St. Louis, both of Mo.

[73] Assignee: Angelica Corporation, St. Louis, Mo.

[21] Appl. No.: 104,105

[22] Filed: Dec. 17, 1979

[51] Int. Cl.[3] ..... D03D 13/00
[52] U.S. Cl. ..... 428/252; 428/245; 428/246; 428/257; 428/258; 428/260; 428/262
[58] Field of Search ..... 428/224, 225, 245, 257, 428/260, 262, 246, 252, 258; 139/426 R, 420 R, 383 R

[56] References Cited

U.S. PATENT DOCUMENTS

| | | | |
|---|---|---|---|
| 4,127,694 | 11/1978 | Murphy et al. | 428/260 |
| 4,137,357 | 1/1979 | Emmons | 428/257 |
| 4,145,469 | 3/1979 | Newkirk et al. | 428/260 |
| 4,167,603 | 9/1979 | Sistrunk | 428/260 |

*Primary Examiner*—James J. Bell
*Attorney, Agent, or Firm*—Rogers, Eilers & Howell

[57] ABSTRACT

A woven fabric has cotton and polyester therein and has a total combined surface area of less than fifty-three thousand (53,000) microns per square inch and yet has, prior to the application thereto of any finish, a wetting time greater than one-half of a minute.

22 Claims, No Drawings

LONG WETTING TIME WOVEN FABRIC

BACKGROUND OF THE INVENTION

1. Field of the Invention

Persons in some professions and in some occupations find it desirable to wear apparel that includes fabric which has a long wetting time but is not impervious to air. Such apparel can "breathe"; and hence provides more comfort for the wearer than can apparel which includes impervious materials such as rubber, synthetic rubber or plastics. As a result, surgeons, anaesthetists, nurses and other persons who work in the operating rooms of hospitals find it desirable to wear apparel that includes fabric which has a long wetting time but is not impervious to air.

2. Description of the Prior Art

Page 87 of Staple Cotton Fabrics by John Hoye, McGraw-Hill Book Company, Inc., 1942, states:

> "According to research recently made by a committee of the American Association of Textile Chemists and Colorists and reported in the Dyestuff Reporter of Jan. 5, 1942, it has been shown that the amount of resistance of a treated fabric to water penetration is dependent more upon its construction than upon the water repellent used. The closer woven the fabric, the better the resistance of the finished fabric to water penetration of water".

Page 247 of Textile Fibers, Yarns and Fabrics, by Ernest R. Kaswel, Reinhold Publishing Corporation, 1953, states:

> "Of the untreated samples, the cotton duck and wool melton offer the best resistance to a hydrostatic head and spray test. In addition, the cotton duck offers the best resistance to water absorption. These two fabrics are probably the thickest and most tightly woven and it would be expected that they would offer higher resistance on this basis alone".

A printed sheet of Ashton Brothers & Company Limited states:

> "VENTILE FABRICS are made from fine, long staple cotton which is spun into yarn and then doubled for additional strength. The cloth is woven in an Oxford weave which ensures that the threads are set in the most compact arrangement".

A further woven fabric, which is made from cotton, is woven in an Oxford weave; and it is woven so the warp thereof has one hundred and eighty-four (184) two-ply (72/2) ends per inch in the greige state and so the filling thereof has eighty (80) two-ply (60/2) picks per inch in that state. The average diameter of the ends is one hundred and ninety-two (192) microns, and the average diameter of the picks is one hundred and ninety-eight (198) microns. As a result, that woven fabric has a total combined surface area greater than fifty-three thousand (53,000) microns per square inch. However, the wetting time of that woven cloth is only five seconds; and, after fifty washings, that wetting time is only two seconds.

SUMMARY OF THE INVENTION

A woven fabric has cotton and polyester in the threads thereof; and those threads are woven to provide a total combined surface area of less than fifty-three thousand (53,000) microns per square inch. Yet, that woven fabric has, prior to the application thereto of any finish, a wetting time longer then one-half of a minute.

As a result, that woven fabric is permeable to air but can resist the transmission of liquids through it. It is, therefore, an object of the present invention to provide a woven fabric which has cotton and polyester in the threads thereof and which has those threads woven to provide a total combined surface area of less than fifty-three thousand (53,000) microns per square inch, and yet has, prior to the application thereto of any finish, a wetting time longer than one-half of a minute.

Other and further objects and advantages of the present invention should become apparent from an examination of the following specification.

In the following specification, a preferred embodiment of the present invention is described, but it is to be understood that the specification is for the purpose of description only and does not limit the invention and that the invention will be defined by the appended claims.

DESCRIPTION OF PREFERRED EMBODIMENT

The preferred embodiment of woven fabric, that is provided by the present invention, has a warp which is constituted by ends that are made from an intimate blend of cotton and polyester, and has a fill which is constituted by picks that are made from a blend of cotton and polyester. Although various polyesters could be used in the cotton-polyester blends for the ends and picks, Fortrel 410 polyester and the corresponding Dacron polyester have been found to be very useful. Various cotton-polyester blends could be used for the ends and picks, but a blend of fity percent (50%) cotton and fifty percent (50%) polyester has been found to be very useful. Multi-ply ends and picks could be used, but two-ply ends and picks have been found to be very useful.

In the preferred embodiment of woven fabric, the ends were made from two-ply (50/2) thread which was fifty percent (50%) peeler cotton and fifty percent (50%) polyester and which had an average diameter of two hundred and thirty-seven microns. The yarn which was used in making that thread was combed but not waxed. The picks were made from two-ply (50/2) thread which was fifty percent (50%) peeler cotton and fifty percent (50%) polyester and which had an average diameter of two hundred and twenty-four microns. The yarn which was used in making that thread was combed but not waxed. That fabric was woven in a plain weave, rather than in an Oxford weave; and, in the greige state, had one hundred and thirty-seven (137) ends per inch and had seventy (70) picks per inch. That woven fabric was given a standard Quarpel finish and an antistatic finish. As finished, that woven fabric had one hundred and forty (140) ends per inch and had seventy-eight (78) picks per inch.

The total combined surface area (TCSA), in microns per square inch, of a woven fabric is determined by the formula $Dw+Df=TCSA$; where Dw is the number of ends per inch multiplied by the average diameter of those ends in microns, and where Df is the number of picks per inch multiplied by the average diameter of those picks in microns. In the preferred embodiment of woven fabric, Dw is one hundred and forty (140) multiplied by two hundred and thirty-seven (237) or thirty-three thousand one hundred and eighty (33,180). The Df is seventy-eight (78) multiplied by two hundred and twenty-four (224) or seventeen thousand four hundred and seventy-two (17,472). The resulting total combined surface area in microns per square inch is fifty thousand six hundred and fifty-two (50,652).

In the greige state, the preferred embodiment of woven fabric has a wetting time of one minute and fifty-four seconds and has an air permeability of one cubic foot of air per minute per square foot of area with a pressure differential as small as one-half (½) of an inch of water. Also, that woven fabric can withstand a hydrostatic pressure of nine and six-tenths (9.6) inches of water. After fifty (50) washings of the type customarily used in industrial laundries, that woven fabric had two minutes and forty-seven seconds of wetting time and had an air permeability of one and six-tenths (1.6) cubic feet of air per minute per square foot of area with a pressure differential as small as one half (½) of an inch of water. Also, that woven fabric withstood a hydrostatic pressure of eleven and two-tenths (11.2) inches of water. Further, that woven fabric withstood one hundred and thirty-six (136) abrasion cycles in an abrade-to-destruction test. After that woven fabric was given the standard Quarpel finish and the antistatic finish, it had a wetting time that was longer than the maximum time period used in wetting time tests, it had an air permeability of one and fifty-seven hundredths (1.57) cubic feet of air per minute per square foot of area with a pressure differential as small as one half (½) of an inch of water, and it withstood a hydrostatic pressure of fifty-nine and eight-tenths (5.98) inches of water. After fifty (50) washings of the type customarily used in industrial laundries, that finished woven fabric had a wetting time of twenty minutes, had an air permeability of one and fifty-nine hundredths (1.59) cubic feet of air per minute per square foot of area with a pressure differential as small as one-half (½) of an inch of water, and it withstood a hydrostatic pressure of twenty-four and six-tenths (24.6) inches of water. Further, that finished woven fabric withstood three hundred and twenty-five (325) abrasion cycles in an abrade-to-destruction test.

The prior woven fabric, which is described hereinbefore in the Description of the Prior Art, is made wholly of cotton and has an Oxford weave. The warp of that prior woven fabric is constituted by ends that were made from two-ply (72/2) pima cotton thread which has a diameter of one hundred and nintey-two (192) microns; and the fill of that prior woven fabric is constituted by picks that were made from two-ply (60/2) pima cotton thread which has a diameter of one hundred and ninety-eight (198) microns. The yarns that were used for making those threads were combed but not waxed. In the greige state, that prior woven fabric had one hundred and eighty-four (184) ends per inch and had eighty (80) picks per inch. That prior woven fabric was given a standard Quarpel finish. As finished, that prior woven fabric had one hundred and niney-six (196) ends per inch and had eighty-two (82) picks per inch.

The Dw of that prior woven fabric is one hundred and ninety-six (196) multiplied by one hundred and ninety-two (192) or thirty-seven thousand six hundred and thirty-two (37,632). The Df of the prior woven fabric is eighty-two (82) multiplied by one hundred and ninety-eight (198) or sixteen thousand two hundred and thirty-six (16,236). The resulting total combined surface area in microns per square inch is fifty-three thousand eight hundred and sixty-eight (53,868).

In the greige state, that prior woven fabric has a wetting time of only five seconds and has an air permeability of one and eight-tenths (1.8) cubic feet of air per minute per square foot of area with a pressure differential as small as one-half (½) of an inch of water. That prior woven fabric can withstand a hydrostatic pressure of nine and five-tenths (9.5) inches of water. After fifty (50) washings of the type customarily used in industrial laundries, that prior woven fabric had only two seconds of wetting time and had one and six-tenths cubic feet of air per minute per square foot of area with a pressure differential as small as one-half (½) of an inch of water. Also, that prior woven fabric withstood a hydrostatic pressure of twelve and five-tenths (12.5) inches of water. Further, that prior woven fabric withstood forty-six (46) abrasion cycles in an abrade-to-destruction test. After that prior woven fabric was given the standard Quarpel finish, it had a wetting time that was longer than the maximum time period used in wetting time tests, it had an air permeability of two and fifteen hundredths (2.15) cubic feet of air per minute per square foot of area with a pressure differential as small as one half (½) inches of water, and it withstood a hydrostatic pressure of fifty inches of water. After fifty (50) washings of the type customarily used in industrial laundries, that finished prior woven fabric has a wetting time of ten minutes, had an air permeability of one and eighty-eight hundredths (1.88) cubic feet of air per minute per square foot of area with a pressure differential as small as one-half (½) of an inch, and it withstood a hydrostatic pressure of nineteen (19) inches of water. Further, that finished prior woven fabric withstood one hundred and forty-four (144) abrasion cycles in an abrade-to-destruction test.

A comparison of the wetting time of the preferred embodiment of woven fabric with the wetting time of the prior woven fabric shows surprising and unexpected increases—from five seconds to one minute and fifty-four seconds in the dyed but finish-free state, from two seconds to two minutes and forty-seven seconds in the dyed but finish-free state after fifty (50) washings of the type customarily used in industrial laundries, and from ten minutes to twenty minutes in the finished state after fifty (50) washings of the type customerarily used in industrial laundries. Those increases are particularly surprising and unexpected, because that preferred embodiment of woven fabric uses a plain weave instead of the Oxford weave espoused by Ashton Brothers & Company Limited, uses a lower total combined surface area than does the prior woven fabric despite the teachings of Hoye and Kaswel, and uses inexpensive peeler cotton rather than the expensive "fine, long staple" (pima) cotton espoused by Ashton Brothers & Company Limited.

A comparison of the hydrostatic pressure withstood by the preferred embodiment of woven fabric in the dyed but finish-free state with the hydrostatic pressure withstood by the prior woven fabric in the dyed but finish-free state shows a surprising and unexpected result. Although that prior woven fabric consisted wholly of cotton, and hence could rely upon all portions thereof to swell during a hydrostatic pressure test to provide a desirably-high resistance to water penetration, the resistance of that prior woven fabric to water penetration was not substantially greater than the resistance of the preferred embodiment of woven fabric to water penetration. This, despite the fact that the polyester in the preferred embodiment of woven fabric experiences only slight swelling when wet, and also despite the fact that the preferred embodiment of woven fabric has only about one-half (½) as much cotton as does the prior woven fabric. Also, a comparison of the hydrostatic pressure withstood by the preferred embodiment of woven fabric in the finished state after fifty (50) washing cycles of the type customarily used in industrial laundries, with the hydrostatic pressure withstood by the prior woven fabric in the finished state after fifty (50) washing cycles of the type customarily used in industrial laundries, shows a surprising and unexpected result. Although that prior woven fabric consisted wholly of cotton, and hence could rely upon all portions thereof to swell during a hydrostatic pressure test to provide a desirably-high resistance to water penetration, the resistance of the washed prior woven fabric to water penetration was proportionally less than the resistance of the washed preferred embodiment of woven fabric to water penetration. Specifically, because the resistance of the finished preferred embodiment of woven fabric to water penetration decreased only from fifty-nine and eight-tenths (59.8) to twenty-four and six-tenths (24.5) after fifty (50) washing cycles of the type customarily used in industrial laundries, the fifty (50) centimeter resistance to water penetration of the finished prior woven fabric might not be expected to decrease below twenty and five-tenths (20.5) after fifty (50) washing cycles of the type customarily used in industrial laundries. However, the resistance of the washed prior woven fabric to water penetration was below twenty and five-tenths (20.5) centimeters—being as low as nineteen (19) centimeters. This despite the fact that the prior woven fabric could rely upon all portions thereof to swell during the hydrostatic test, whereas one-half (½) of the preferred embodiment of woven fabric is polyester which experiences no significant swelling when wet.

Any increase in wetting time without a reduction in resistance to water penetration would be useful and valuable in a woven fabric to be used in apparel for hospital operating rooms, because that increase would help keep blood, sputum, other body fluids, saline solution, and other solutions and liquids from passing inwardly through that apparel. It should be noted that most of the portions of a surgical gown which enclose the wearer's torso are vertically directed, and hence will tend to permit blood, sputum, other body fluids, saline solutions, and other solutions and liquids which contact the exterior of those portions to run down and drip off of that apparel rather than be absorbed by the woven fabric of that apparel. Also, it should be noted that the portions of a surgical gown which enclose the lower surfaces of the wearer's arms will almost immediately shed any blood, sputum, other body fluids, saline solutions, and other solutions and liquids which contact those portions. In addition, it should be noted that the portions of a surgical gown which enclose the upper surfaces of the wearer's arms will be convex and hence will tend to shed any blood, sputum, other body fluids, saline solutions, and other solutions and liquids which contact those portions. By increasing the wetting time of the preferred embodiment of woven fabric, the present invention gives blood, sputum, other body fluids, saline solutions, and other solutions and liquids ample time to drain or fall away from that woven fabric before they can be absorbed by that woven fabric.

The number of ends per inch, in the warp of the woven fabric provided by the present invention, can be varied, but that number should be more than one hundred and twenty-five (125) and less than one hundred and eighty (180). Similarly, the number of picks per inch, in the fill of the woven fabric provided by the present invention, can be varied, but that number should be more than sixty-five (65) and less than eighty-one (81). The sum of the picks and ends per inch in the woven fabric provided by the present invention, can be varied, but that number should be more than two hundred (200) but less than two hundred and fifty (250). The air permeability of that woven fabric should be at least eight-tenths (0.8) of a cubic foot of air per minute per square foot of area with a pressure differential as small as one-half (½) of an inch of water. Also, that woven fabric should be able to withstand a hydrostatic pressure of at least eight (8) centimeters of water, and have a wetting time longer than one-half of a minute.

As used herein, wetting time is the time required for the specular reflection of a drop of water, which has fallen a short distance onto a piece of fabric, to disappear. In determining the wetting time of a piece of fabric, that piece of fabric is mounted in an embroidery hoop, and then a buret is used to deposit a single drop of water on the upper surface of that piece of fabric; all as specified in the AATCC Test Method 39-1977 of the American Association of Textile Chemists and Colorists. If that piece of fabric has a long wetting time, that drop of water will remain a discrete and well-rounded drop for a substantial period of time, and thereafter will retain a three-dimensional, although not well-rounded, configuration for an additional period of time. The wetting time is the total time the drop has a visible specular reflection.

The woven fabric which is provided by the present invention is particularly useful in making gowns for surgeons and other operating room personnel. However, that fabric is useful in any situation where air permeability greater than eight-tenths (0.8) of a cubic foot per minute of air per square foot of area with a pressure differential as small as one-half (½) of an inch of water and a wetting time longer than one-half of a minute are desired.

Whereas the foregoing specification has described a preferred embodiment of the present invention, it should be apparent to those skilled in the art that various changes may be made in the form of the invention without affecting the scope thereof.

What we claim is:

1. A woven fabric which, prior to the application of any finish thereto, has a wetting tire longer than one-half of a minute and an ability to withstand a hydrostatic pressure greater than eight (8) centimeters of water, and which comprises ends that are formed from a mixture of cotton and polyester and picks that are formed from a mixture of cotton and polyester, and wherein the sum of picks and ends per inch is less than two hundred and fifty (250).

2. A woven fabric as claimed in claim 1 wherein said woven fabric can, after it has been washed fifty (50) times, withstand more than one hundred (100) abrasion cycles in an abrasion-to-destruction test.

3. A woven fabric as claimed in claim 1 wherein said woven fabric responds to the application thereto of a Quarpel finish and an anti-static finish to be able to withstand a hydrostatic pressure greater than fifty (50) centimeters of water.

4. A woven fabric as claimed in claim 1 wherein said woven fabric responds to the application thereto of a Quarpel finish and an anti-static finish to be able to withstand more than two hundred (200) abrasion cycles in an abrasion-to-destruction test even after it has been washed fifty (50) times.

5. A woven fabric as claimed in claim 1 wherein said woven fabric responds to the application thereto of a Quarpel finish and an anti-static finish to have a wetting time longer than fifteen minutes even after it has been washed fifty (50) times.

6. A woven fabric as claimed in claim 1 wherein said woven fabric has an air permeability greater than eight-tenths (0.8) of a cubic foot per minute of air per square foot of area with a pressure differential as small as one-half (½) of an inch of water.

7. A woven fabric as claimed in claim 1 wherein said woven fabric has more than one hundred and twenty-five (125) ends per inch.

8. A woven fabric as claimed in claim 1 wherein said woven fabric has fewer than eighty-one (81) picks per inch.

9. A woven fabric as claimed in claim 1 wherein said woven fabric responds to the application thereto of a Quarpel finish and an anti-static finish to have an air permeability greater than one and twenty-five hundredths (1.25) cubic feet per minute of air per square foot of area with a pressure differential as small as one-half (½) of an inch of water.

10. A woven fabric as claimed in claim 1 wherein said woven fabric has cotton in the ends thereof in the range of forty percent to sixty percent (40%–60%) and has polyester in said ends in the range of sixty percent to forty percent (60%–40).

11. A woven fabric as claimed in claim 1 wherein said woven fabric has cotton in the picks thereof in the range of forty percent to sixty percent (40%–60%) and has polyester in said picks in the range of sixty percent to forty percent (60%–40%).

12. A woven fabric as claimed in claim 1 wherein said woven fabric has cotton in the ends and picks thereof in the range of forty percent to sixty percent (40%–60%) and has polyester in said ends and picks thereof in the range of sixty percent to forty percent (60%–40%).

13. A woven fabric which, prior to the application of any finish thereto, has an air permeability greater than eight-tenths (0.8) of a cubic foot per minute of air per square foot of area with a pressure differential as small as one half (½) of an inch of water, a wetting time longer than one-half of a minute, and an ability to withstand a hydrostatic pressure greater than eight (8) centimeters of water, and which comprises plural-ply ends that have a count greater than one hundred and twenty-five (125) per inch but less than one hundred and eighty (180) per inch, and picks that have a count greater than sixty-five (65) per inch but less than eighty-one (81) per inch, said woven fabric having a cotton content in the range of forty percent to sixty percent (40%–60%) and having a polyester content in the range of sixty percent to forty percent (60%–40%).

14. A woven fabric which, prior to the application of any finish thereto, has an air permeability greater than eight-tenths (0.8) of a cubic foot per minute of air per square foot of area with a pressure differential as small as one-half (½) of an inch of water, a wetting time longer than one-half of a minute, and an ability to withstand a hydrostatic pressure greater than eight (8) centimeters of water, and which comprises ends that are formed from a mixture of cotton and polyester and picks that are formed from a mixture of cotton and polyester, and wherein the number of ends per inch is less than one hundred and eighty (180).

15. A woven fabric which, prior to the application of any finish thereto, has a wetting time longer than one-half of a minute and an ability to withstand a hydrostatic pressure greater than eight (8) centimeters of water, and which comprises ends that are formed from a mixture of cotton and polyester and picks that are formed from a mixture of cotton and polyester, and wherein the total combined surface area is less than fifty-three thousand (53,000) microns per square inch.

16. A woven fabric as claimed in claim 1 wherein said cotton is peeler cotton.

17. A woven fabric as claimed in claim 13 wherein said cotton is peeler cotton.

18. A woven fabric as claimed in claim 14 wherein said cotton is peeler cotton.

19. A woven fabric as claimed in claim 15 wherein said cotton is peeler cotton.

20. A woven fabric which, prior to the application of any finish thereto, has an ability to withstand a hydrostatic pressure greater than eight (8) centimeters of water and which comprises ends that are formed from a mixture of cotton and polyester, and wherein the sum of picks and ends per inch is less than two hundred and fifty (250).

21. A woven fabric which, after the application of a Quarpel finish and of an antistatic finish thereto, has an ability to withstand a hydrostatic pressure greater than fifty (50) centimeters of water and which has, after fifty (50) washing cycles of the type customarily used in industrial laundries, an ability to withstand a hydrostatic pressure greater than nineteen (19) centimeters of water, and which comprises ends that are formed from a mixture of cotton and polyester and picks that are formed from a mixture of cotton and polyester, and wherein the sum of picks and ends per inch is less than two hundred and fifty (250).

22. A woven fabric which, prior to the application of any finish thereto, has an ability to withstand a hydrostatic pressure greater than eight (8) centimeters of water and which has, after fifty (50) washing cycles of the type customarily used in industrial laundries, an ability to withstand a hydrostatic pressure greater than ten (10) centimeters of water and which comprises ends that are formed from a mixture of cotton and polyester and picks that are formed from a mixture of cotton and polyester, and wherein the sum of picks and ends per inch is less than two hundred and fifty (250).

* * * * *

UNITED STATES PATENT OFFICE

CERTIFICATE OF CORRECTION

Patent No. 4,286,012 Dated August 25, 1981

Inventor(s) Howard M. Zins; Edward L. Morris, Jr.

It is certified that error appears in the above-identified patent and that said Letters Patent are hereby corrected as shown below:

"has" in line 22 of column 4 should be -had-;

a comma should be inserted between "This" and "despite" in line 28 of column 5;

"tire" in line 46 of column 6 should be -time-;

"%" should be inserted after "40" in line 28 of column 7.

Signed and Sealed this

Fifth Day of January 1982

[SEAL]

Attest:

GERALD J. MOSSINGHOFF

Attesting Officer

Commissioner of Patents and Trademarks